US006865779B2

(12) United States Patent
Gillanders

(10) Patent No.: US 6,865,779 B2
(45) Date of Patent: Mar. 15, 2005

(54) ERGONOMIC BRACE FOR INLINE POWER TOOL

(76) Inventor: David D. Gillanders, 1969 Chevy Chase Dr., Brea, CA (US) 92821

( * ) Notice: Subject to any disclaimer, the term of this patent is extended or adjusted under 35 U.S.C. 154(b) by 140 days.

(21) Appl. No.: 10/350,752

(22) Filed: Jan. 24, 2003

(65) Prior Publication Data

US 2004/0143938 A1 Jul. 29, 2004

(51) Int. Cl.[7] ..... B25G 3/00; B25G 1/04

(52) U.S. Cl. ..... 16/430; 16/422; 16/426; 16/901; 16/DIG. 12; 81/489; 294/58

(58) Field of Search ..... 16/430, 901, 422, 16/426, DIG. 12; 81/177.1, 177.8, 489; 294/19.1, 57, 58, 59; 15/144.1, 144.2, 144.3, 143.1; D7/357, 361, 395; 173/170, 171, 218, 219, 162.1, 162.2

(56) References Cited

U.S. PATENT DOCUMENTS

| | | | | | |
|---|---|---|---|---|---|
| 2,244,585 | A | * | 6/1941 | Tweit | 16/426 |
| 4,924,924 | A | * | 5/1990 | Stewart | 142/49 |
| 5,156,429 | A | * | 10/1992 | Adams | 294/25 |
| 5,445,479 | A | * | 8/1995 | Hillinger | 408/16 |
| 5,455,981 | A | * | 10/1995 | Wiese | 15/236.01 |
| 5,546,749 | A | * | 8/1996 | Couchee | 60/370 |
| 5,661,960 | A | * | 9/1997 | Smith et al. | 56/12.7 |
| 5,716,087 | A | * | 2/1998 | Backich et al. | 294/55 |
| 5,890,259 | A | * | 4/1999 | Sarac | 16/422 |
| 6,021,854 | A | * | 2/2000 | Scarola | 173/170 |
| 6,082,795 | A | * | 7/2000 | Fornelli | 294/58 |
| 6,112,831 | A | * | 9/2000 | Gustafsson | 173/162.2 |
| 6,324,728 | B1 | * | 12/2001 | Blankenheim | 16/431 |
| 6,581,246 | B1 | * | 6/2003 | Polette | 16/429 |

FOREIGN PATENT DOCUMENTS

| | | | | |
|---|---|---|---|---|
| DE | 3908501 | A1 | * 9/1989 | A22B/5/20 |

* cited by examiner

*Primary Examiner*—Chuck Y. Mah

(57) ABSTRACT

An ergonomic brace attachment for a pneumatic inline power tool. The attachment is designed to reduce the forces transmitted from the power tool to the operator. The device attaches non-destructively to a wide variety of inline power tools using the threaded air inlet port of the tool. A padded lever arm allows the operator to easily receive torque forces and the semi-u shape enables axial force to be applied to the tool with the large muscles of the arm, while providing for minimal restriction and ease of use. The lever arm is made from lightweight, strong material and is height-adjustable to accommodate a wide variety of tools and operator anatomies.

9 Claims, 1 Drawing Sheet

ERGONOMIC BRACE FOR INLINE POWER TOOL

BACKGROUND OF THE INVENTION

The present invention relates to pneumatically powered inline tools, especially hand-held screwdrivers, nutrunners, impact wrenches and drills. These tools generate start-up and reactive torque forces, which can be injurious to the human anatomy. A device, which could safely distribute the forces created by inline power tools, is clearly indicated and necessary to the welfare of the human operator. Present methods employed to protect operators from these forces include "torque arm tool supports". These devices consist of an arm, which either clamps to the tools, or attaches to the tools utilizing the air inlet pipe thread that is common to such tools. The opposing end of the arm is attached to a structure, such as a workbench frame. The torque arm tool supports do an effective job of absorbing torque, but at the cost of tool mobility and perceived usability by the operator, since the tool is rigidly connected to a semi-stationary structure. This arrangement decreases the freedom of movement that an operator desires in order to correctly position the tool for work. Another type of attachment, which is well represented in prior art, is a brace which attaches to the power tool and provides a lever to reduce and refer torque forces away from the vulnerable wrist joint of the operator. These braces have a disadvantage in that they clamp to the body of the tool. This attachment means necessitates an accurately sized and shaped clamping collar, specific to each tool. An example of this prior art design is the Bio-Brace (T.M.) device manufactured by DG Industries of Brea, Calif. Other devices, in an effort to provide more versatility, employ a vee-shaped jaw clamp attachment which is problematic, as it exerts uneven circumferential pressure on the sensitive housing of the tool, which can result in tool malfunction or premature failure and damage to the outside surface of the tool, so that if the brace were removed, the gripping area of the tool could be comprimised in surface quality enough to cause discomfort or injury to the operator. A jaw clamp type of attachment has also a disadvantage of unnecessary additional weight. An example of such a brace is disclosed in U.S. Pat. No. 6,324,728.

SUMMARY OF THE INVENTION

The present invention is an ergonomic biomechanical forearm brace attachment for a pneumatic inline power tool. The attachment is designed to reduce forces from the power tool transmitted to the operator. A common feature of all pneumatic power tools is a threaded air inlet port. A significant improvement to the prior art would consist of an ergonomic forearm brace which would attach to the power tool using the air inlet connection thread and would provide a comfortable, padded, and insulated lever arm which would refer torque forces to the operator's forearm where they are reduced and easily tolerated and bypass the operator's wrist entirely. A height adjustment on the lever arm would provide adaptation to a variety of tool lengths, operator anatomy and work piece dimensional specifics. The lever arm could also be formed in a semi-u shape, to enable the operator to apply a desired amount of axial force to the tool using the large muscles of the arm, should the work piece application require. In summary, an ergonomic biomechanical forearm brace with tool air inlet attachment means, easily integrated with existing prior art pneumatic power tools, would be a significant improvement resulting in reduced operator fatigue and improved operational efficiencies. The following description and accompanying drawings will illustrate an embodiment of the present invention.

DETAILED DESCRIPTION OF THE INVENTION

Figure 1:
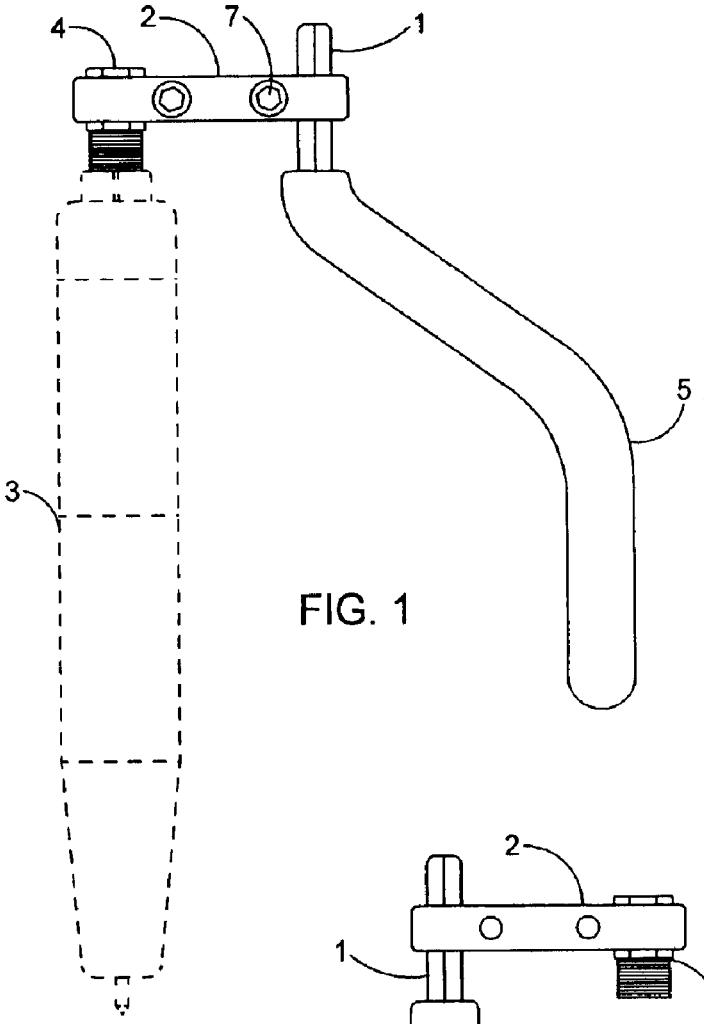
FIG. 1 is a left side plan view of the invention attached to an inline power tool.

Referring to FIG. 1, the invention is shown attached to an inline power tool (3). The lever arm (1) is shown at a mid-height position in the attachment mechanism (2). By loosening clamp screw (7), the lever arm may be adjusted for height. A resilient, padded covering (5) provides comfort for the operator. The threaded attachment fitting (4) is shown threaded in the inline power tool. The compressed air supply is connected to the opposite end of the threaded attachment fitting.

Figure 2:
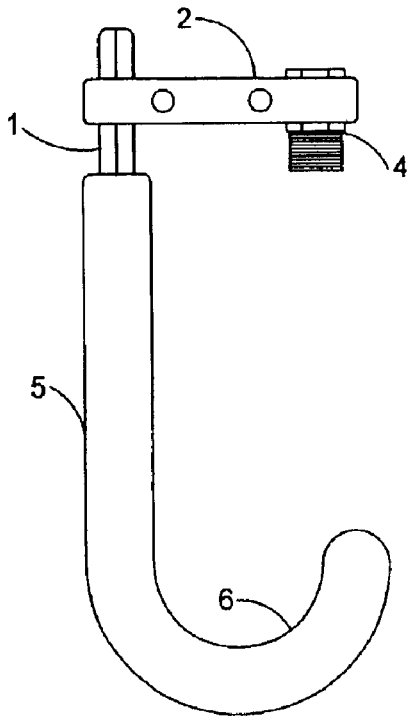
FIG. 2 is a front plan view of the invention.

Referring to FIG. 2, the invention is shown rotated 90 degrees and the semi-u shape (6) of the lever arm (1) is disclosed. The lever arm may be formed in other shapes as well, dictated by workstation and operator particulars.

Figure 3:
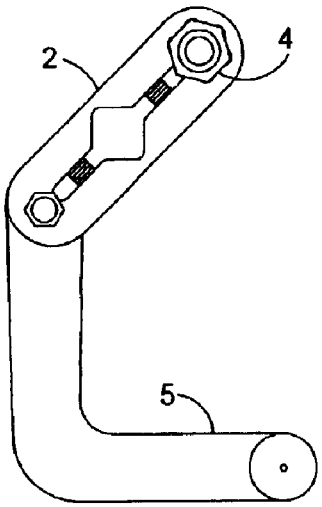
FIG. 3 is a top plan view of the invention.

Referring to FIG. 3, the invention is shown from the top and the non-rotatable couplings in the attachment mechanism (2) are shown.

While the invention has been described with reference to preferred embodiments, these should not be construed as limiting the scope of the invention and are meant to be exemplary only. Accordingly, the scope of the invention should be determined not by the embodiment(s) illustrated, but by the appended claims and their legal equivalents.

I claim:

1. An ergonomic brace for an inline power tool comprising:

an attachment mechanism having two ends for attaching the ergonomic brace to the inline power tool, said attachment mechanism having at one end a threaded hole engaging a threaded coupler, the other end having a non-circular hole receiving an end of a semi-U shaped lever arm, said attachment mechanism further having at least one clamp screw for clamping and unclamping said end of said lever arm in said non-circular hole so that said lever arm can be adjusted through said non-circular hole;

said lever arm attached to the attachment mechanism for providing support and force reduction for and to the arm, wrist and hand of a human operator; and wherein the semi-U shaped portion of the lever arm cradles the arm of the operator when in use.

2. The ergonomic brace of claim 1 wherein the attachment mechanism is removable and attachable to a variety of power tools.

3. The ergonomic brace of claim 1 wherein the lever arm is attached to the attachment mechanism with a non-rotatable coupling; wherein the non-rotatable coupling provides for height adjustment to adapt to a variety of power tools and human anatomies.

4. The ergonomic brace of claim 1 wherein the attachment mechanism is fixedly attached to the threaded coupler for coupling to an inline power tool.

5. The ergonomic brace of claim 4 wherein the coupler a threaded air inlet port of the inline power tool.

6. The ergonomic brace of claim 1 wherein the attachment mechanism and lever arm are made from a strong, light-weight material.

7. The ergonomic brace of claim 1 wherein the lever arm is covered in an insulating and resilient material.

8. The ergonomic brace of claim 1 wherein the lever arm is formed in the semi-u shape to enable the operator's arm to couple and de-couple from the device.

9. The ergonomic brace of claim 1 wherein the lever arm is formed in the semi-u shape to enable the operator to generate axial force on the tool, using the large muscles of the arm.

* * * * *